United States Patent [19]

Bilofsky et al.

[11] 4,269,916

[45] May 26, 1981

[54] PHOTOGRAPHIC PRINTS UTILIZING LAMELLAR PIGMENT MATERIALS

[75] Inventors: Ruth C. Bilofsky, Lexington; Howard G. Rogers, Weston, both of Mass.

[73] Assignee: Polaroid Corporation, Cambridge, Mass.

[21] Appl. No.: 153,589

[22] Filed: May 27, 1980

Related U.S. Application Data

[60] Division of Ser. No. 921,186, Jul. 3, 1978, Pat. No. 4,216,018, which is a continuation-in-part of Ser. No. 744,598, Nov. 24, 1976, abandoned.

[51] Int. Cl.[3] ..... G03C 1/84; G03C 1/78; G03C 1/96

[52] U.S. Cl. ..... 430/11; 106/291; 106/300; 430/14; 430/523

[58] Field of Search ..... 430/14, 11, 220, 510, 430/523; 106/291, 300; 428/404, 323, 538

[56] References Cited

U.S. PATENT DOCUMENTS

| | | | |
|---|---|---|---|
| 2,713,004 | 7/1955 | Greenstein | 106/193 |
| 3,008,844 | 11/1961 | Gronin et al. | 106/193 |
| 3,071,482 | 1/1963 | Miller | 106/148 |
| 3,123,489 | 3/1964 | Bolomey et al. | 106/291 |
| 3,123,490 | 3/1964 | Bolomey et al. | 106/291 |
| 3,594,165 | 7/1971 | Rogers | 430/212 |
| 3,647,437 | 3/1972 | Land | 430/221 |
| 3,928,037 | 12/1975 | DeHaes | 430/220 |

OTHER PUBLICATIONS

"Nacreous Pigments", Greenstein, *Encyc. of Polymer Sci. and Techn.* vol. 10, 1969, pp. 193–211.

Jenkins et al., *Fundamentals of Optics,* McGraw-Hill Book Co., Inc., New York, 1957, pp. 543–547.

*Handbook of Chem. and Physics,* The Chem. Rubber Co., Cleveland, Ohio, 1972, pp. B-192–B-197.

*Primary Examiner*—Richard L. Schilling

*Attorney, Agent, or Firm*—Louis G. Xiarhos

[57] ABSTRACT

Photographic products having reflective layers which comprise lamellar interference pigments.

18 Claims, 11 Drawing Figures

PHOTOGRAPHIC PRINTS UTILIZING LAMELLAR PIGMENT MATERIALS

CROSS REFERENCE TO RELATED APPLICATIONS

This application is a division of U.S. application Ser. No. 921,186, filed July 3, 1978, now U.S. Pat. No. 4,216,018 which in turn is a continuation in part of now-abandoned U.S. application Ser. No. 744,598, filed Nov. 24, 1976.

BACKGROUND OF THE INVENTION

1. The Field of the Invention

This invention relates to photographic products and processes and particularly to diffusion transfer photographic products and processes.

2. Description of the Prior Art

Diffusion transfer photographic products and processes are known to the art and details relating to them can be found in U.S. Pat. Nos. 2,983,606; 3,415,644; 3,415,645; 3,415,646; 3,473,925; 3,482,972; 3,551,406; 3,573,042; 3,573,043; 3,573,044; 3,576,625; 3,576,626; 3,578,540; 3,569,333; 3,579,333; 3,594,164; 3,594,165; 3,597,200; 3,647,437; 3,672,486; 3,672,890; 3,705,184; 3,752,836; 3,857,865; and British Pat. No. 1,330,524.

Essentially, diffusion transfer photographic products and processes involve film units having a photosensitive system including at least one silver halide layer usually integrated with an image-providing material. After photoexposure, the photosensitive system is developed to establish an imagewise distribution of a diffusible image-providing material, at least a portion of which is transferred by diffusion to an image-receiving layer capable of mordanting or otherwise fixing the transferred image-providing material. In some diffusion transfer products, the transfer image is viewed by reflection after separation of the image-receiving element from the photosensitive system. In other products however, such separation is not required and instead, the transfer image in the image-receiving layer is viewed against a reflecting background usually provided by a dispersion of a white, light-reflecting pigment—such as titanium dioxide.

Diffusion transfer photographic processes and products providing a dye image viewable against a reflecting background without separation are oftentimes referred to in the art as, "integral negative-positive film units" and such units are of two general types. Integral negative-positive film units of the first type as described, for example, in the above-noted U.S. Pat. No. 3,415,644 include appropriate photosensitive layer(s) and image dye-providing materials carried on an opaque support, an image-receiving layer carried on a transparent support and means for distributing a processing composition between them. Photoexposure is made through the transparent base and image-receiving layer and a processing composition which includes a reflecting pigment is distributed between the image-receiving and photosensitive components. After distribution of the processing composition and before processing is complete, the film unit can be—and usually is—transported into light. Accordingly, in integral negative-positive film units of this type the reflecting pigment-containing layer must be capable of performing specific and critical assigned functions. Until processing is complete, for example, the distributed reflecting layer must be able to provide at least partial protection against further exposure of the photoexposed element but at the same time permit transfer of the image dyes through the layer of processing composition and light-reflecting pigment to the image-receiving layer. After transfer, the layer must provide a suitably efficient reflecting background for viewing the dye image transferred to the image-receiving layer since the image is viewed through the same side of the film unit as exposure was effected.

Integral negative-positive film units of a second type, as described for example, in U.S. Pat. No. 3,594,165, include a transparent support, carrying the appropriate photosensitive layers and associated image dye-providing materials, a permeable opaque layer, a permeable layer containing a light-reflecting pigment, an image-receiving layer viewable through the transparent support against the light-reflecting layer, and means for distributing a processing composition between the photosensitive layer and a transparent cover or spreader sheet. Additionally, integral negative-positive film units of this second type have means for providing an opaque processing composition to provide a second opaque layer after photoexposure to prevent additional exposure of the photosensitive element. In film units of this second type, exposure is made through the transparent cover sheet. After distribution of the processing composition and installation of the second opaque layer, this type of film unit can also be transported into light before processing is complete. Accordingly, in film units of this second type, the reflecting pigment-containing layer may also perform the critical assigned functions of providing at least partial protection for the photoexposed element until processing is complete without interfering with transfer of the image dyes. Also after transfer is complete, the layer must provide a suitable reflecting background for viewing the dye image transferred through the reflecting pigment-containing layer.

In view of the above, the performance characteristics desired of reflecting pigments employed in integral negative-positive film units can be said to be reasonably well defined. When employed in film units of the first type, they must be compatible with and dispersible in the processing composition so that upon distribution, a layer can be provided presenting the requisite degree of opacity for the photoexposed element as well as a suitable degree of permeability for effective dye transfer. Likewise, when employed in film units of the second type, the pigments ideally should be capable of being effectively dispersed in selected polymeric matrix materials to provide coating dispersions adaptable to high speed, high volume coating techniques involved in commercial film manufacturing processes, and to provide uniform layers having the capability of providing the requisite opacity and permeablility discussed above. Additionally, when used in either type of film unit, the optical properties of the pigment as well as the layer containing it must be such so as to present an efficient light-reflecting background for viewing the dye image against it.

As mentioned, reflecting layers of integral negative-positive film units known to the art have usually employed titanium dioxide as the reflecting pigment most nearly meeting the requisite performance characteristics discussed above. Particularly useful titanium dioxides have been commercially available, generally spherical, rutile titanium dioxides having an average particle size of about 0.2 microns.

SUMMARY OF THE INVENTION

Photographic products and processes presented by way of the present invention include novel light-reflecting layers providing a substantially white background against which the image is viewed. Essentially, the novel white light-reflecting layers of the products and processes of the present invention comprise lamellar, interference pigments dispersed in a suitable matrix material. The lamellar, interference pigments of this invention are flat, platelike, transparent or slightly translucent, white light-reflecting, single or multi-layer pigments. These pigments can be broadly defined as having at least one layer which has a geometric thickness within the following expression:

$$T = \frac{\lambda}{4} / n \text{ (or an odd multiple thereof).}$$

where: T is the geometric (or physical) thickness, λ represents a wavelength or wavelength range of radiation in the visible region of the spectrum, n represents the refractive index of the layer material and is at least 1.7.

In the case of multi-layer pigments, any layer next adjacent a layer of the above specifications is of a different layer material but has a geometric thickness within the above expression. In other words, adjacent layers of multi-layer pigments of this invention have different refractive indices and can have the same but usually have different geometric thicknesses within the above expression.

The preferred individual, singe-layer lamellar pigments of the reflecting layers of the present invention are highly efficient white light-reflecting pigments having a pair of substantially parallel reflective surfaces and a geometric thickness (T) between the surfaces within the expression:

$$T = \frac{\lambda}{4} / n \text{ (or an odd multiple thereof).}$$

where, as already mentioned, λ is a wavelength or wavelength range of radiation within the visible region and n represents the refractive index of the layer material and is at least 1.7.

The expression ("λ"/4) is referred to here as the "optical thickness" of the single layer pigment. The preferred single layer pigments of this invention are those having an optical thickness which will provide maximum reflection efficiency for radiation of a wavelength or wavelength range in the visible region of the spectrum (particularly from about 4500 Å to about 6500 Å). Accordingly, single layer pigments of this invention can have an optical thickness between about 1125 Å (4500 Å/4) and about 1625 Å (6500 Å/4). Especially preferred are those single layer pigments having an optical thickness between about 1250 Å to about 1375 Å so that the pigment will provide maximum reflection efficiency for radiation in or near the midvisible region of the spectrum (from about 5000 Å to about 5500 Å).

The single layer lamellar pigments are prepared using materials having a refractive index above 1.7. Particularly preferred single layer lamellar pigment materials are those having refractive indices between about 2.0 to about 2.8. Accordingly, the corresponding geometric thicknesses for single layer pigments prepared from these particularly preferred materials are within the range of from about 450 Å to about 700 Å. Although single layer lamellar pigments having geometric thicknesses between about 450 Å to about 700 Å are particularly preferred in the practice of the present invention, it should be understood that single layer lamellar pigments having geometric thicknesses above or below the preferred range can be used. For example, such single layer lamellar pigments can be blended together or with single layer lamellar pigments of the preferred thicknesses to provide efficient white reflecting backgrounds for the products and processes of the present invention.

Materials particularly suitable for preparing single layer lamellar pigments of the present invention are metal oxides and metal salts having a refractive index of at least about 1.7 and preferably between 2.0 to about 2.8 or slightly higher. Especially preferred materials are those metal oxides and metal salts having the above refractive index which are stable and substantially insoluble in aqueous alkali. Particularly preferred materials are zirconium oxides or titanium oxides.

The multi-layer pigments of this invention comprise at least one and preferably more than one layer having the specifications described above for the single layer pigment. The layer next adjacent a layer of the above described specifications is of a different material but has a geometric thickness within the expression described before. In other words, the multi-layer pigments of this invention have one layer with a refractive index above 1.7 with the next adjacent layer having a different and preferably a lower refractive index. Particularly preferred multi-layer pigments are those having an odd number of layers. The most efficient multilayer pigments prepared so far are those having an odd number of layers with layers having a refractive index above 1.7 as the outermost layers.

As mentioned, the novel substantially white, reflecting layers of the present invention comprise single and/or multilayer lamellar pigments dispersed in a suitable matrix material. As those in the art know, the reflection efficiency of a layer depends to a large extent on the difference between the refractive index of the matrix material and the pigment(s) dispersed in it. There is diminished reflection efficiency when the two indexes are similar and improved reflection efficiency as the difference between the indexes is increased. Accordingly, the refractive index of the matrix material is a factor of special importance in selecting suitable matrix materials and special preference is given to those which provide a difference between the refractive index of the matrix material and the index of the dispersed pigment that can present maximum white-light reflection efficiency for the layer. Another consideration of some importance in selecting matrix materials for the reflecting layers of the present invention, especially in film units of the type shown in FIGS. 1 and 2, is that the matrix material be compatible with and permeable by aqueous alkaline processing compositions. Particularly suitable matrix materials are gelatin, polyvinyl alcohols and cellulosic polymeric materials such as hydroxyalkyl celluloses and carboxyalkyl celluloses.

The white reflecting layers of this invention provide excellent reflection efficiency. It has been found for example, that considerably less lamellar pigment than conventional spherical titanium dioxide is needed to provide highly efficient reflecting layers for viewing dye images. In commercial diffusion transfer film units of the type described in U.S. Pat. No. 3,415,644, the amount of spherical titanium dioxide used in the processing composition based on the % by weight of the titanium dioxide to the total weight of the processing composition is enough to provide a reflecting layer with a spherical titanium dioxide pigment coverage of about 4000 mgs/ft$^2$. However, in accordance with the practice of this invention, the amount of lamellar pigment needed to provide efficient reflecting layers can be about one-half or less of the amount of spherical titanium dioxide. For example, highly efficient light-reflecting layers of this invention can be obtained by using an amount of single layer lamellar pigment to provide a layer having a single layer, lamellar pigment coverage of about 2000 mgs/ft$^2$. In the case of multi-layer lamellar pigments, highly efficient reflecting layers can be obtained using an amount of multilayer pigment to provide a multi-layer lamellar pigment coverage of about 1000 mgs/ft$^2$.

The improved reflection efficiency of layers of this invention is believed to be due to a constructive interference phenomenon. This constructive interference is obtained because the single or multi-layer lamellar pigments comprise a layer or layers having an optical thickness of $\lambda/4$. Under such circumstances, the amplitude or intensity of reflection from the layer will depend on two reflections; one from the top surface of the layer and one from the bottom surface. If the relative phase difference between the two reflections is 180°, they will recombine in such a way that the resultant amplitude will be the difference of the amplitude of the two components. If the relative phase difference is zero or a multiple of 360°, the resultant amplitude will be the sum of the two components. The former case is called destructive interference and the latter case is called constructive interference which is achieved with the lamellar pigments of this invention. For example, in the case of a single layer lamellar pigment where the optical thickness is one quarter of a wavelength thick and the index of refraction (n) is higher than that of the surround or matrix material, the two reflections would undergo a relative phase change of zero and would recombine constructively at the surface. In a multi-layer lamellar pigment consisting of say five layers, all one quarter wavelength thick with alternative high and low indices and with the high index layers outermost, light reflected within the high index layer would undergo a phase change of zero, while light reflected in the low index layers will undergo a phase change of 180°. Therefore, the reflection at the surface will be the result of six beams, all in phase, recombining constructively.

Additional details relating to lamellar pigments and the constructive interference phenomenon can be found in: H. A. MacLeod, *Thin Film Optical Filters, American Elsevier* Publishing Co., Inc., New York, 1969; A. Vasicek, *Optics of Thin Films,* North Holland Publishing Co., Amsterdam, 1960; R. W. Ditchburn, Light, Interscience Publishers, Inc., New York, 1953; L. M. Greenstein and A. J. Petro, "Nacreous Pigments", *Encyclopedia of Chem. Tech.* Vol. 10, p 193–218; F. A. Jenkins and H. E. White, *Fundamentals of Optics,* 4th Edition, McGraw Hill, New York, 1976.

Also, details relating to methods for producing lamellar pigments can be found in U.S. Pat. Nos. 3,331,699; 3,138,475; 3,123,490; 3,123,489; 3,071,482; 3,008,844 and 2,713,004.

DESCRIPTION OF THE PREFERRED EMBODIMENTS

The particularly preferred film units of the present invention are integral negative-positive film units of the two types discussed before. Details relating to the first type are found in such Patents as U.S. Pat. Nos. 3,415,644 and 3,647,437 while details of the second type are found in such Patents as U.S. Pat. No. 3,594,165 and British Pat. No. 1,330,524.

Figure 1:
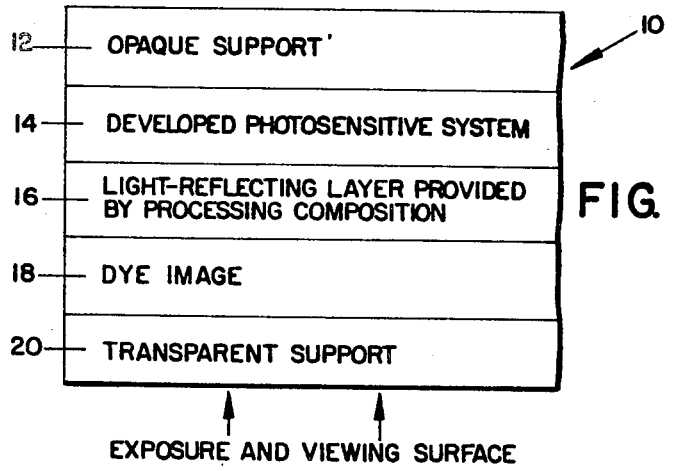
FIGS. 1–3 are simplified or schematic views of arrangements of essential elements of preferred film units of the present invention, shown after exposure and processing.

Referring now to FIG. 1, a film unit of the type of referenced U.S. Pat. Nos. 3,415,644 and 3,647,437 is shown following exposure and processing. The film unit 10 includes a white light-reflecting layer provided by a light-reflecting pigment in a processing composition initially present in a rupturable processing container (not shown). The light reflecting layer is formed by distributing the processing composition after photoexposure of photosensitive layer(s) 14 through transparent support 20 and image-receiving layer 18. Processing compositions used in such film units are aqueous alkaline photographic processing compositions comprising a binder or matrix material and an opacifying system which includes a lamellar pigment of this invention as the light-reflecting agent, preferably in combination with an optical filter agent described in detail in U.S. Pat. No. 3,647,437. Processing compositions of this type have a refractive index of about 1.5. When the processing composition is distributed over all portions of photoexposed photosensitive system 14, a light-reflecting layer 16 comprising the lamellar pigment is provided between image-receiving layer 18 and photosensitive layer 14. Application of the processing composition initiates developing of photoexposed photosensitive layer(s) 14 to establish an imagewise distribution of diffusible image-providing material which can comprise silver but preferably comprises one or more dye image providing materials. The diffusible image-providing material(s) is transferred through permeable, light-reflecting, lamellar pigment containing layer 16 where it is mordanted, precipitated or otherwise retained in known manner in image-receiving layer 18. The transfer image is viewed through transparent support 20 against light-reflecting layer 16.

As disclosed in U.S. Pat. No. 3,615,421, film units of the type shown in FIG. 1 can include those having preformed light-reflective layers through which the photosensitive system may be exposed. According to the practice of the present invention, such film units comprise a preformed layer containing a lamellar pigment positioned between photosensitive system 14 and image-receiving layer 18. For example, such a layer may be coated on the surface of image-receiving layer 18 facing layer 14 and/or coated over the photosensitive system, for example, on the surface of layer 14 facing layer 18. Light-transmissive layers containing about 300 mgms/ft$^2$ of lamellar pigment are suitable. Photoexposure of the photosensitive system is made through support 20, layer 18, and the light-transmissive layer containing the lamellar pigment. After photoexposure, distribution of the processing composition to provide light-reflecting layer 16 is made as described before and preferably the processing composition comprises additional reflective pigment all or part of which can be lamellar pigments.

Figure 2:
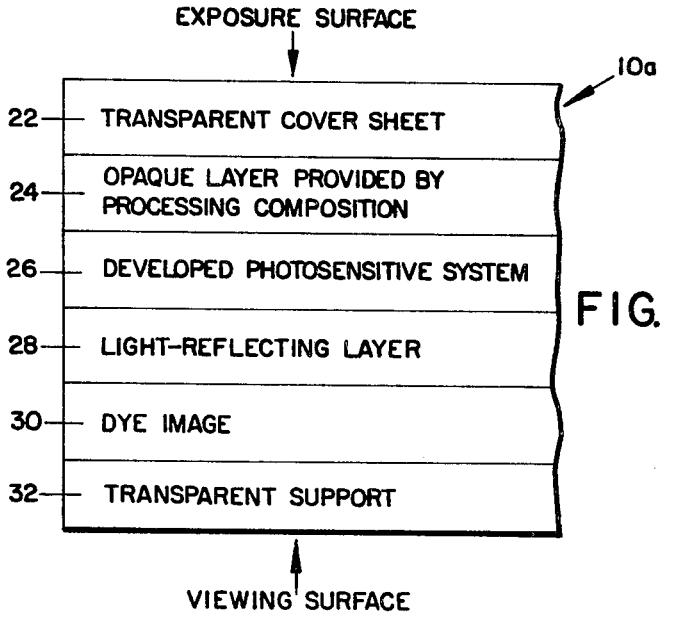

FIG. 2 shows an arrangement of essential elements of a film unit of the types described in referenced U.S. Pat. No. 3,594,165 and British Pat. No. 1,330,524 following exposure and processing. The film unit 10*a* includes a processing composition initially retained in a rupturable container (not shown) and distributed between cover sheet 22 and photosensitive system or layer 26 after photoexposure of photosensitive element(s) 26 through transparent cover sheet 22. Processing compositions used in such film units are aqueous alkaline photographic processing compositions which include an opacifying system comprising an opaque pigment which need not be—and usually is not—light reflecting. After distribution of the processing composition between transparent cover sheet 22 and photoexposed photosensitive layer 26, an opaque layer 24 is installed which protects layer 26 from further photoexposure through cover sheet 22. Like the film units of FIG. 1, upon distribution of opaque layer 24, the processing composition initiates developing of photoexposed photosensitive layer 26 to establish an imagewise distribution of the image-providing materials. For example, the processing composition alone may cause development or developing agents may be in the processing composition initially and/or the agents may be in the film unit so that they may be carried to layer 26 by the processing composition. The imagewise distribution is transferred through permeable, lamellar pigment containing reflecting layer 28 to dye image element 30 for viewing through transparent support 32 against the lamellar pigment containing layer 28. Preferably an opaque layer (not shown) is positioned between developed photosensitive layer 26 and light reflecting layer 28.

Figure 3:
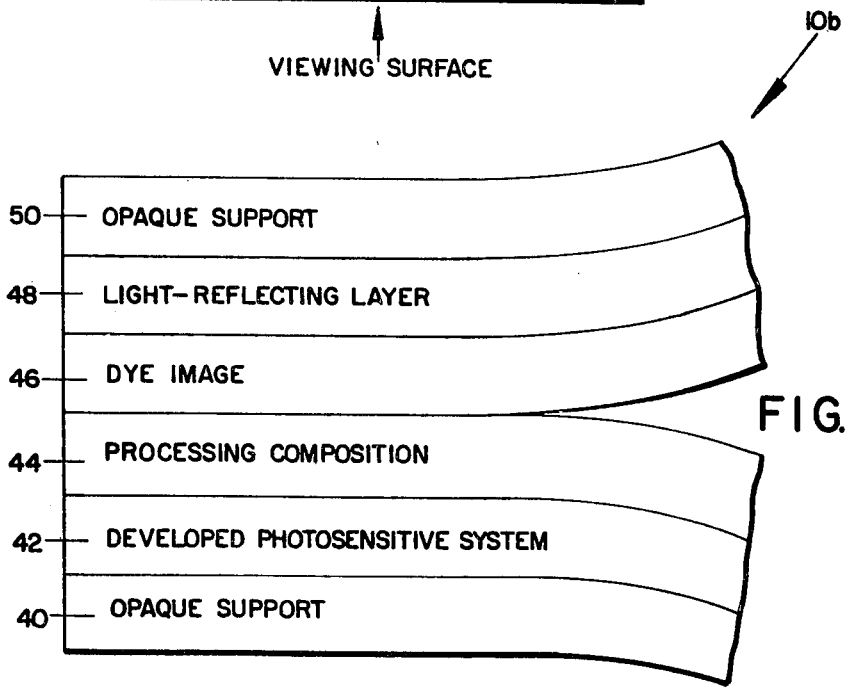

The novel light-reflecting layers of the present invention also may be utilized in film units designed to be separated after processing to provide photographic products having dye image-providing materials viewable against a reflecting background comprising a lamellar pigment carried by a support (preferably opaque). Such a diffusion transfer film unit of the present invention is shown in FIG. 3 as 10*b*. The film unit shown there comprises a photosensitive element having an opaque support carrying a photosensitive system containing layer(s) 42. In film units of this type, the photosensitive element is photoexposed and a processing composition 44 is then distributed over the photoexposed system. During processing an image-receiving element comprising dye image layer 46 light-reflecting, lamellar pigment containing layer 48, and support 50—preferably opaque—is superposed on the photoexposed photosensitive element. Like the film units of FIGS. 1 and 2, the processing composition permeates layer(s) 42 to provide an imagewise distribution of diffusible dye image-providing materials which is transferred to dye image layer 46. Unlike the film units of FIGS. 1 and 2, however, the transferred dye image is viewed in layer 46 against light-reflecting layer 48 after separation of the image-receiving element from the photosensitive element.

Suitable photosensitive systems employed in the film units described above are well known to the art and they include those providing silver images as well as color and multicolor images, as set forth in detail in various patents cross-referenced herein. The most preferred systems are multilayer systems involving a blue-, a green-, and a red-sensitive silver halide layer integrated respectively with a yellow, a magenta, and a cyan dye image-providing material.

The invention will be better appreciated by reference to the following illustrative Examples.

EXAMPLE 1

This Example describes a method used to produce an individual, single-layer lamellar titanium dioxide pigment of this invention.

In a vacuum chamber, sodium chloride was introduced into a tungsten boat-type source over which a precleaned, soft glass substrate (18"×24") was suspended at a distance of about 76 cms. The chamber was pumped down to $2.\times10^{-5}$ mm Hg at which time deposition of the sodium chloride on the substrate began and was allowed to continue slowly. The coating thickness of the sodium chloride was monitored by a quartz crystal oscillator and the deposition was terminated at a thickness of about 250 A°.

A layer of titanium dioxide was deposited on the sodium chloride from an electron beam gun employing a bent beam of about 270° and positioned about 76 cms. from the substrate in the following manner.

A boule of $TiO_2$ was previously made from dry hot pressed pellets of $TiO_2$ (¼" major dimension) by carefully sweeping the surface of the charge with the electron beam while gradually increasing the power output level until the desired fused mass was obtained. At a vacuum of $5\times10^{-5}$ mm Hg, power was applied to the electron beam gun with the shutter (protecting the substrates) closed. When the entire surface of the charge was molten and spitting was minimal, the shutter was opened. Thickness and rate of deposition were monitored by a quartz crystal oscillator. With the rate adjusted to approximately 600 A°/min., the deposition was allowed to continue until the desired geometric thickness was attained (450–600 A°).

By repeating the above procedure, twenty successive layers of $TiO_2$ and sodium chloride were obtained containing about 1.25 grams of lamellar $TiO_2$. The lamellar titanium dioxide was recovered by washing with $H_2O$ to remove the sodium chloride and provide flakes of lamellar $TiO_2$. (The lamellar $TiO_2$ may be washed with acetone if desired. The acetone wash appears to reduce lamination of the flakes to each other during drying which is preferably carried out over a desiccant ($CaSO_4$) at aspirator pressure.) After drying, the flakes were calcined in air at 500° C.–700° C. for from about two to about five hours.

The calcined lamellar titanium dioxide flakes were reduced in size by sonification and separated by elutriating in distilled water. The resultant slurry contained lamellar titanium dioxide flakes with a particle size (major dimension) distribution between about 1.9 to about 11.3 microns with about 70% of the flakes having a major dimension of no greater than about 6.3 microns. (In the practice of the present invention, lamellar titanium dioxide pigments or flakes having a major dimension of no more than about 7.0 microns and a ratio of the major to minor dimension no greater than about 5:1 have been found to be particularly suitable.)

EXAMPLE 2

This Example illustrates a method for producing individual, single-layer zirconium dioxide pigments of this invention. In this Example, a release layer of sodium fluoride is used in preparing the lamellar zirconium dioxide pigment. Methods for preparing lamellar pigments using sodium fluoride release layers and the advantages derived from the use of such release layers are described in more detail in U.S. Pat. No. 4,168,986 (issued Sept. 25, 1979 to Joseph J. Venis, Jr.).

In this preparation, a polyester substrate (4 mil. Mylar) was conducted through a vacuum chamber divided into two separate coating areas each having an electron beam gun employing a 270° bent beam. In the first coating area, a release layer of sodium fluoride was applied first to the moving polyester substrate by vapor deposition. The rate of deposition of sodium fluoride on the Mylar substrate was controlled by rate of evaporation and the speed of the moving substrate to provide a layer of sodium fluoride about 500 A.

In the second coating area, zirconium dioxide was evaporated and deposited on the sodium fluoride release layer of the polyester substrate. In this second coating area, the rate of evaporation of the zirconium dioxide was controlled at a deposition rate to provide a layer of zirconium oxide having a geometric thickness of 600 Å. Pressures in both chambers were maintained between about $5\times10^{-6}$ to about $5\times10^{-5}$ mm of mercury during the vapor deposition operations. Thickness of the layer and the rate of deposition in both coating areas were controlled and monitored by separate quartz crystal sensor heads in each coating area connected to separate digital deposition controllers.

After the vapor deposition operations were complete, the roll of coated polyester was removed from the vacuum chamber and washed with water to remove the zirconium dioxide pigment. The pigment was collected by filtration, washed with distilled water to remove sodium fluoride and dried. In washing, the final wash should have a conductivity of about 70 micromhos or less indicating that substantially all of the sodium fluoride has been removed. The dry zirconium dioxide pigment was then calcined in air at temperatures ranging between about 400° to about 900° C. for 1 to 4 hours.

The calcined zirconium dioxide pigment was reduced in size by sonification and separated by elutriating in distilled water. The resultant slurry contained lamellar zirconium dioxide flakes with a particle size (major dimension) between about 1 to about 12 microns.

EXAMPLE 3

This Example involves a direct comparison of the reflecting efficiency of a lamellar titanium dioxide pigment with the reflecting efficiency of a spherical, rutile titanium dioxide pigment. In this comparison, diffusion transfer processing compositions containing titanium dioxide pigments were spread on a surface of image-receiving components of integral negative-positive film units. These image-receiving components are integral parts of elements V300 and V304 below and each component initially comprised the following layers in order; a first transparent polyester support having an anti-reflection layer coated on one surface, a polymeric acid layer coated on the other surface of the support, a "timing" spacer layer coated on the polymeric acid layer and an image-receiving layer coated on the timing spacer layer. The thickness as well as the particular composition of ingredients of the layers of the image-receiving components are described in detail in the next Example. (Details relating to the anti-reflection coating can be found in U.S. Pat. No. 3,793,022 and U.S. Pat. No. 3,925,081.)

A container retaining a titanium dioxide pigment containing diffusion transfer processing composition and a spreader sheet were taped to one end of each image-receiving component. The spreader sheet comprised a transparent polyester support (4 mils thick) coated with a gelatin layer of about 200 mgms/ft$^2$, the gelatin layer of the spreader sheet faced the image-receiving layer of the image-receiving component. Accordingly, application of pressure to the container caused distribution of the diffusion transfer processing composition between the image-receiving layer and the gelatin layer of the spreader sheet.

Except for the differences in pigments, the processing composition were identical and contained the following ingredients:

| | |
|---|---|
| Water | 95.84 g |
| Potassium Hydroxide (45%) | 16.33 g |
| N-Phenethyl-α-Picolinium Bromide (50% Solution in Water) | 4.08 g |
| Sodium Carboxymethyl-Hydroxyethyl Cellulose | 2.72 g |
| Titanium Dioxide Pigment | 16.25 g |
| Benzotriazole | 1.27 g |
| 6-Bromo-5-Methyl-4-Azabenzimidazole | 0.03 g |
| $Zn(NO_3)_2 \cdot 6H_2O$ | 0.64 g |
| 2,5-Dimethyl Pyrazole | 0.27 g |

The titanium dioxide pigment in the processing composition of element V300 was "Ti-Pure R-100", a commercially available rutile titanium dioxide pigment having an average particle diamter of about 0.2 microns; the titanium dioxide pigment in the processing composition of element V304 was a lamellar titanium dioxide pigment prepared as in Example 1. The reflecting layers applied as described above provided a titanium dioxide pigment coverage for each layer of about 600 mgms/ft$^2$.

The relative reflection normal to the surface of each reflecting layer of elements V300 and V304 was measured at a variety of angles of incident light. These reflection measurements were made through the first support (through the anti-reflection coating) and measurements were made on the day the reflecting layers were formed and six and fifteen days after the layers were formed. The measurements were made on an instrument consisting of a collimated white light source and a detector with photopic response. For standardization, the instrument was set to read 100 units for the reflection of a magnesium carbonate block with the detector at 0° normal and the angle of incidence at 45°. All of the reflection measurements obtained and listed in Table 1 below are relative to that standard.

TABLE 1

RELATIVE REFLECTANCE VS ANGLE OF INCIDENCE

| | | ANGLE OF INCIDENCE | | | | | | | | |
|---|---|---|---|---|---|---|---|---|---|---|
| COMPONENT | DAY | 10° | 15° | 20° | 25° | 30° | 35° | 40° | 45° | 50° |
| $MgCO_3$ | 1,6&15 | 149 | 143 | 138 | 131 | 124 | 117 | 108 | 100 | 90 |

TABLE 1-continued

| RELATIVE REFLECTANCE VS ANGLE OF INCIDENCE | | | | | | | | | | |
|---|---|---|---|---|---|---|---|---|---|---|
| | | ANGLE OF INCIDENCE | | | | | | | | |
| COMPONENT | DAY | 10° | 15° | 20° | 25° | 30° | 35° | 40° | 45° | 50° |
| V300 | 1 | 112 | 107 | 104 | 100 | 94 | 89 | 82 | 75 | 66 |
| V300 | 6 | 110 | 106 | 102 | 97 | 92 | 87 | 80 | 72 | 64 |
| V300 | 15 | 105 | 99 | 94 | 92 | 86 | 82 | 77 | 72 | 66 |
| V304 | 1 | 131 | 123 | 113 | 103 | 95 | 85 | 76 | 67 | 58 |
| V304 | 6 | 158 | 146 | 131 | 117 | 102 | 89 | 78 | 67 | 58 |
| V304 | 15 | 167 | 154 | 138 | 124 | 107 | 95 | 81 | 73 | 63 |

Figure 4:
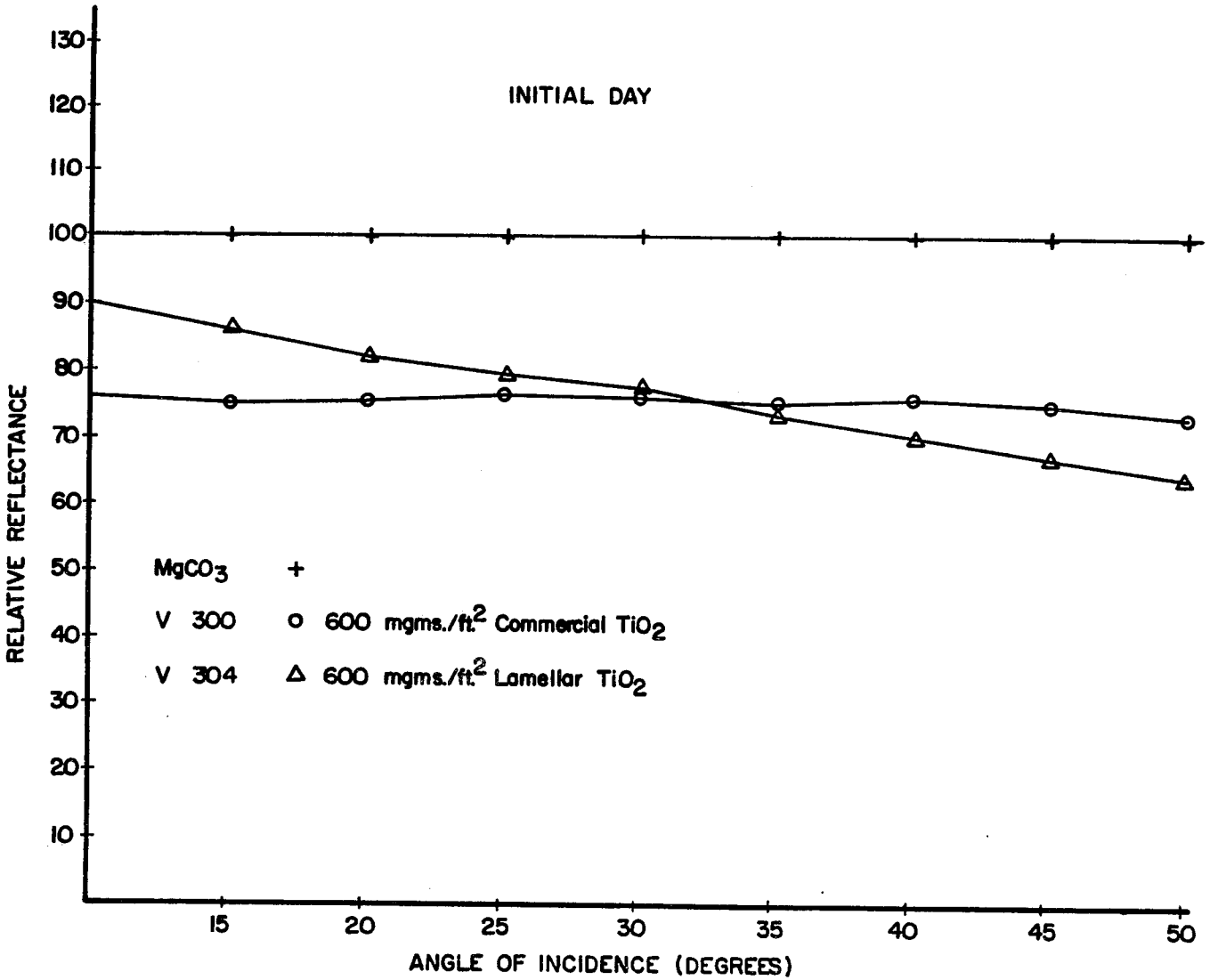
FIGS. 4–6 are graphs depicting data obtained in Example 3.
Figure 5:
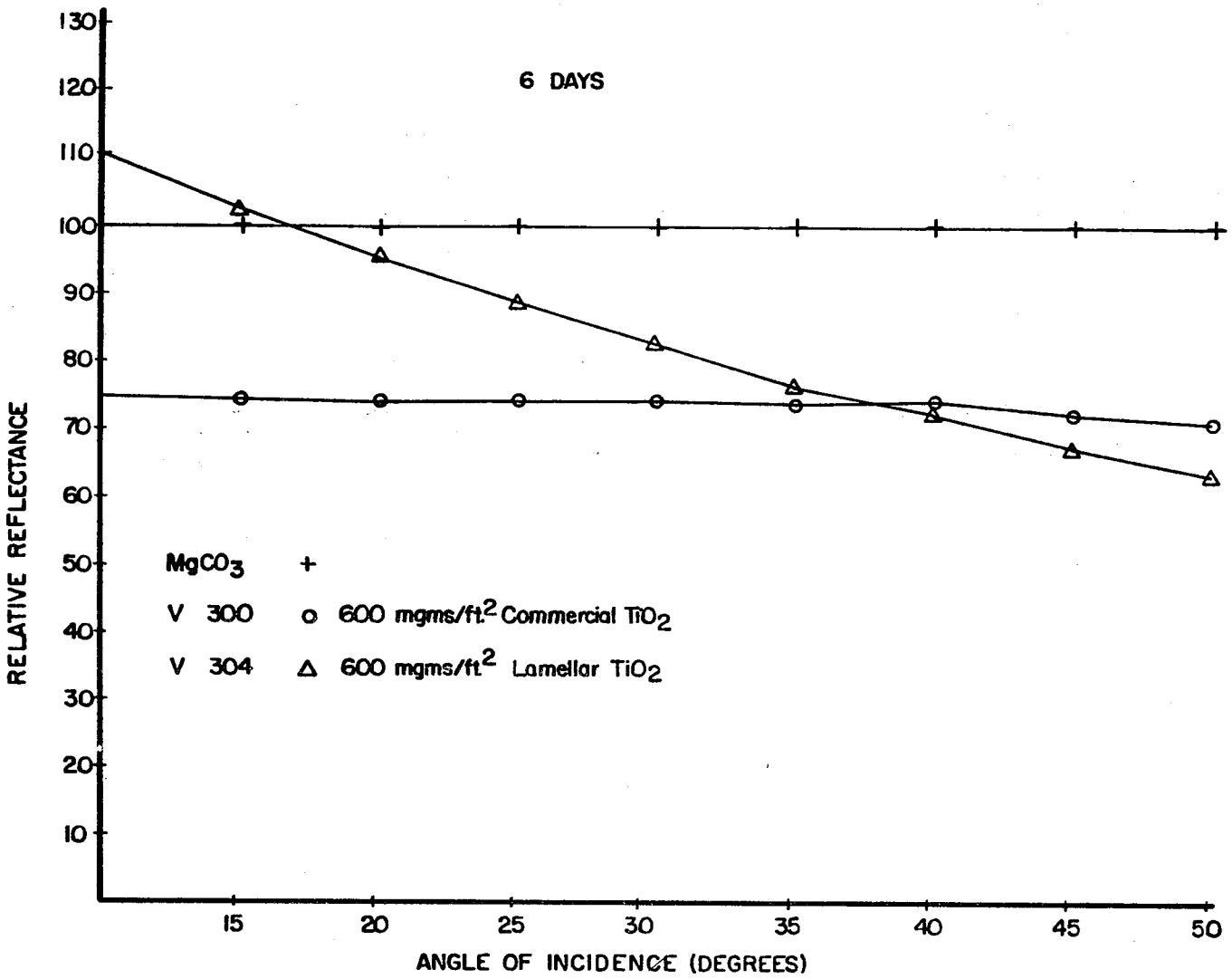
Figure 6:
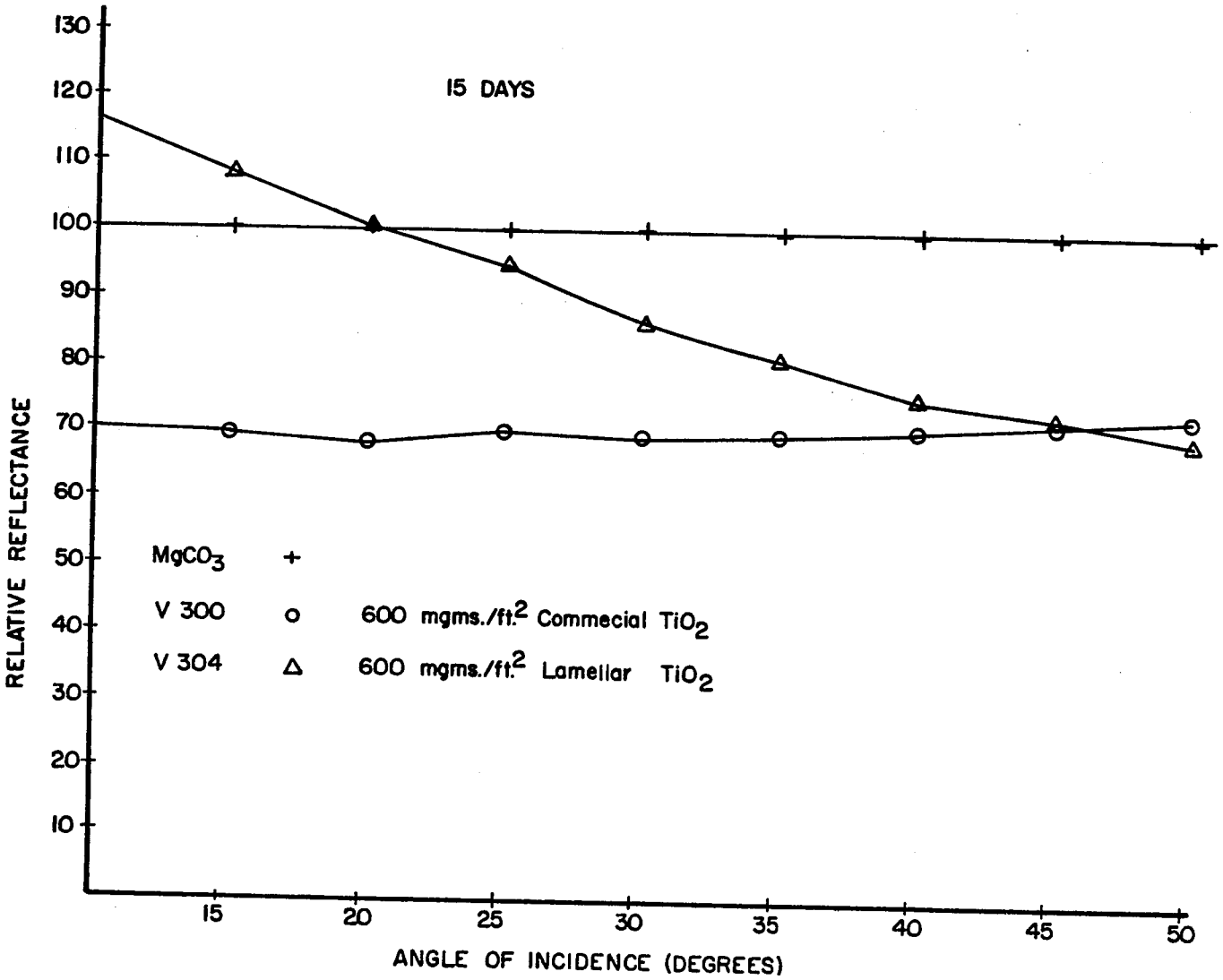

In order to graphically depict the above relative reflection measurements in the manners shown in FIGS. 4, 5 and 6 where the curves for elements V300 and V304 are shown compared to a curve for the $MgCO_3$ which is parallel to the X axis at 100, each of the measurements for the elements—except those for the 45° angles—was recalculated according to the formula:

$$R_2 = \frac{R_1}{R\ MgCO_3} \times 100$$

where $R_1$ is the relative reflective measurement of Table 1 for V300 or V304 at a particular day and angle of incidence, R $MgCO_3$ is the relative reflectance measurement of Table 1 for $MgCO_3$ at the same day and same angle of incidence and, $R_2$ represents the relative reflectance measurement for the element when the relative reflectance for R $MgCO_3$ is normalized to 100.

Table 2 below presents the data obtained by recalculating the measurements in the manner described above.

TABLE 2

| RELATIVE REFLECTANCE VS ANGLE OF INCIDENCE (Relative Reflectance with R $MgCO_3$ = 100 at every angle of incidence) | | | | | | | | | | |
|---|---|---|---|---|---|---|---|---|---|---|
| | | ANGLE OF INCIDENCE | | | | | | | | |
| COMPONENT | DAY | 10° | 15° | 20° | 25° | 30° | 35° | 40° | 45° | 50° |
| $MgCO_3$ | — | 100 | 100 | 100 | 100 | 100 | 100 | 100 | 100 | 100 |
| V300 | 1 | 76 | 75 | 75 | 76 | 76 | 75 | 76 | 75 | 73 |
| V300 | 6 | 75 | 74 | 74 | 74 | 74 | 74 | 74 | 72 | 71 |
| V300 | 15 | 70 | 69 | 68 | 70 | 69 | 70 | 70 | 72 | 73 |
| V304 | 1 | 90 | 86 | 82 | 79 | 77 | 73 | 70 | 67 | 64 |
| V304 | 6 | 110 | 102 | 95 | 89 | 82 | 76 | 72 | 67 | 64 |
| V304 | 15 | 116 | 108 | 100 | 94 | 86 | 81 | 75 | 73 | 70 |

Turning now to FIGS. 4, 5 and 6 which graphically depict the data of Table 2, it will be seen that at substantially equivalent coverages, the lamellar titanium dioxide provides a reflecting layer of improved reflecting efficiency, especially at lower angles of incidence. However, the most dramatic effect illustrated in the Figures is the progressive improvement with time in the reflection efficiency of the lamellar titanium dioxide pigment layer. For example, at one day, (FIG. 4) the relative reflectance of element V304 measured at an angle of incidence of 10° is about 90 and this measurement has increased at six days (FIG. 5) to about 110. However, at 15 days (FIG. 6) the reflectance has increased to about 116, a total increase in reflectance during this time of more than about 25 units. In contrast to the increased relative reflection measurements obtained with the lamellar titanium dioxide reflecting layer, the reflecting layer of element V300 remained substantially unchanged over the 15 day period.

This progressive increase in reflection efficiency as evidenced by the change in the slope and position of the curves in FIGS. 4, 5 and 6 for element V304 may be due to the "drying out" of the reflecting layer, i.e., the evaporation of water from the laminate. It is possible that as the layer "dries out", the plate-like lamellar pigment particles undergo a change in orientation, becoming more parallel to each other and to the top surface of the layer thereby resulting in improved reflectance from the pigments.

Regardless of the precise mechanism involved in the improved reflection efficiency, a visual comparison of elements V300 and V304 readily confirmed the dramatic differences existing between their respective reflecting layers. The lamellar titanium dioxide containing reflecting layer (V304) was more directional and also appeared whiter and more brilliant than the spherical titanium dioxide-containing reflecting layer of element V300 and these observable differences became more pronounced with time.

EXAMPLE 4

This Example involves a comparison of reflecting layers of integral negative-positive film units. One unit (V300A) had a reflecting layer using the commercially available rutile titanium dioxide used in Example 3 ("Ti-Pure R-100") while the other (V304A) had a layer using the lamellar titanium dioxide prepared as described before. The layers provided a titanium dioxide pigment coverage of about 600 mgms/ft$^2$ and except for the pigments used to provide the reflecting layers of the film units V300A and V304A below, each film unit was prepared according to the following procedure:

A multicolor photosensitive element using, as the cyan, magenta and yellow dye developers, cyan:

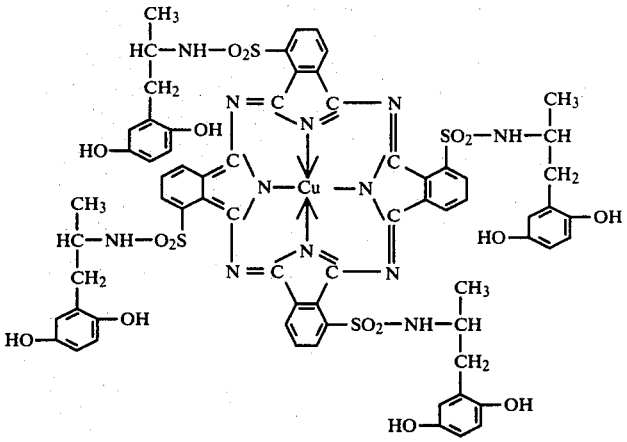

magenta:

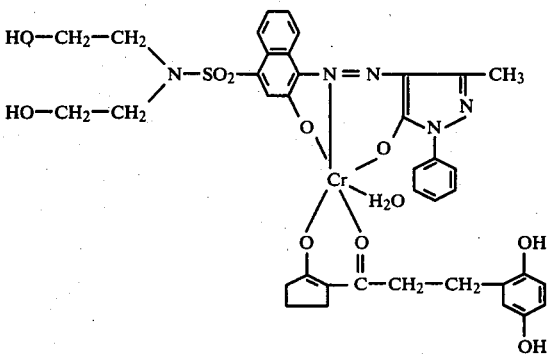

yellow:

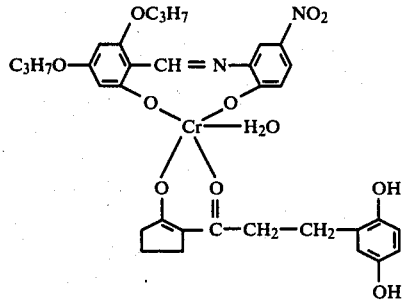

was prepared by coating a gelatin-subcoated 4 mil opaque polyethylene terephthalate film base with the following layers:

1. a layer of cyan dye developer dispersed in gelatin and coated at a coverage of about 70 mgs./ft.$^2$ of dye and about 98 mgs./ft.$^2$ of gelatin;

2. a red-sensitive gelatino silver iodobromide emulsion coated at a coverage of about 120 mgs./ft.$^2$ of silver and about 125 mgs./ft.$^2$ of gelatin;

3. A layer of a 60-30-4-6 tetrapolymer of butylacrylate, diacetone acrylamide, styrene and methacrylic acid and polyacrylamide coated at a coverage of about 250 mgs./ft.$^2$ of the tetrapolymer and about 8 mgs./ft.$^2$ of polyacrylamide;

4. a layer of magenta dye developer dispersed in gelatin and coated at a coverage of about 59 mgs./ft.$^2$ of dye and about 52 mgs./ft.$^2$ of gelatin;

5. a green-sensitive gelatino silver iodobromide emulsion coated at a coverage of about 74 mgs./ft.$^2$ of silver and about 54 mgs./ft.$^2$ of gelatin;

6. a layer containing the tetrapolymer referred to above in layer 3 and polyacrylamide coated at a coverage of about 107 mgs./ft.$^2$ of tetrapolymer and about 12 mgs./ft.$^2$ of polyacrylamide;

7. a layer of yellow dye developer dispersed in gelatin and coated at a coverage of about 70 mgs./ft.$^2$ of dye and about 56 mgs./ft.$^2$ of gelatin;

8. a blue-sensitive gelatino silver iodobromide emulsion layer including the auxiliary developer 4'-methylphenyl hydroquinone coated at a coverage of about 120 mgs/ft.$^2$ of silver, about 60 mgs./ft.$^2$ of gelatin and about 39 mgs./ft.$^2$ of auxiliary developer; and 9. a layer of gelatin coated at a coverage of about 30 mgs./ft.$^2$ of gelatin.

A transparent 4 mil polyethylene terephthalate film base having a quarter wave thick anti-reflection coating of the type described in U.S. Pat. No. 3,925,081 on one surface was coated on the other surface, in succession, with the following layers to form an image-receiving component:

1. as a polymeric acid layer, a partial butyl ester of polyethylene/maleic anhydride copolymer at a coverage of about 2,500 mgs./ft.$^2$;

2. a timing layer containing about a 40:1 ratio of a 60-30-4-6 tetrapolymer of butylacrylate, diacetone acrylamide, styrene and methacrylic acid and polyacrylamide at a coverage of about 500 mgs./ft.$^2$; and 3. a polymeric image-receiving layer containing a 2:1 mixture by weight of polyvinyl alcohol and poly-4-vinylpyridine, at a coverage of about 300 mgs./ft.$^2$.

After photoexposure as described below, the two components were taped together at one end with a container retaining an aqueous alkaline processing composition so mounted that pressure applied to the container would distribute the processing composition between the image-receiving layer and the gelatin overcoat layer of the photosensitive component.

The aqueous alkaline processing composition was distributed at a thickness of 0.0030 inches and comprised:

| | |
|---|---|
| Water | 95.84 g |
| Potassium Hydroxide (45%) | 16.33 g |
| N-Phenethyl-α-Picolinium Bromide (50% Solution in Water) | 4.08 g |
| Sodium Carboxymethyl-Hydroxyethyl Cellulose | 2.72 g |
| Titanium Dioxide Pigment | 16.25 g |
| Benzotriazole | 1.27 g |
| 6-Bromo-5-Methyl-4-Azabenzimidazole | 0.03 g |
| $Zn(NO_3)_2 \cdot 6H_2O$ | 0.64 g |
| 2,5-Dimethyl Pyrazole | 0.27 g |

Before exposure of each photosensitive element, approximately one-half was covered with opaque tape to prevent exposure through the covered portion. Then, each photosensitive element was exposed to a 2-meter-candle-second white light exposure and developed in the dark by distributing the processing composition between the image-receiving component and photoexposed photosensitive component. Under such conditions of exposure, no dye is transferred after processing from the photosensitive component to the image-receiving layer opposite the exposed portion thus providing the "white" or minimum density ($D_{min}$) portion of the transfer image while all dye is transferred from the non-exposed portion to provide the "black" or maximum density ($D_{max}$) areas. Relative reflectance measurements were made on the minimum density portion of each transfer image in the manner described in Example 2 and these measurements were also recalculated as described before to provide relative reflectance measurements at each angle of incidence with the relative reflectance of $MgCO_3$ normalized to 100. Table 3 presents the normalized data.

TABLE 3

RELATIVE REFLECTANCE VS ANGLE OF INCIDENCE
(R $MgCO_3$ Normalized to 100 at Every Angle of Incidence)

| | | ANGLE OF INCIDENCE | | | | | | | | |
|---|---|---|---|---|---|---|---|---|---|---|
| SAMPLE | DAY | 10° | 15° | 20° | 25° | 30° | 35° | 40° | 45° | 50° |
| $MgCO_3$ | — | 100 | 100 | 100 | 100 | 100 | 100 | 100 | 100 | 100 |
| V300A | 1 | 57 | 57 | 57 | 57 | 57 | 57 | 57 | 57 | 56 |
| V300A | 6 | 56 | 55 | 55 | 55 | 56 | 57 | 57 | 57 | 56 |
| V300A | 15 | 52 | 49 | 48 | 48 | 47 | 47 | 47 | 47 | 47 |
| V304A | 1 | 75 | 73 | 71 | 67 | 67 | 63 | 61 | 59 | 59 |
| V304A | 6 | 83 | 75 | 70 | 65 | 61 | 59 | 56 | 55 | 54 |
| V304A | 15 | 105 | 93 | 82 | 72 | 64 | 58 | 53 | 49 | 47 |

Figure 7:
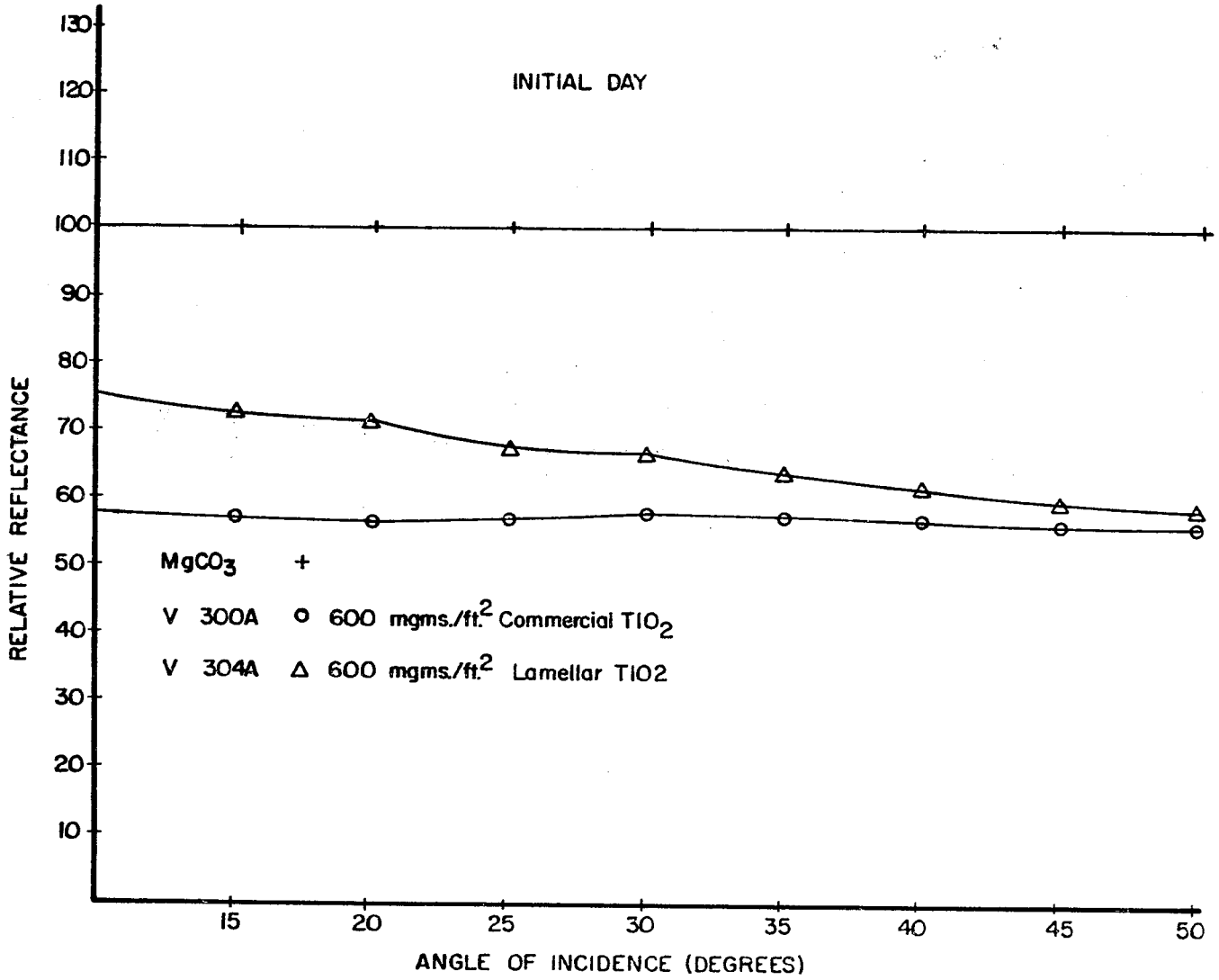
FIGS. 7–9 are graphs depicting data obtained in Example 4.
Figure 8:
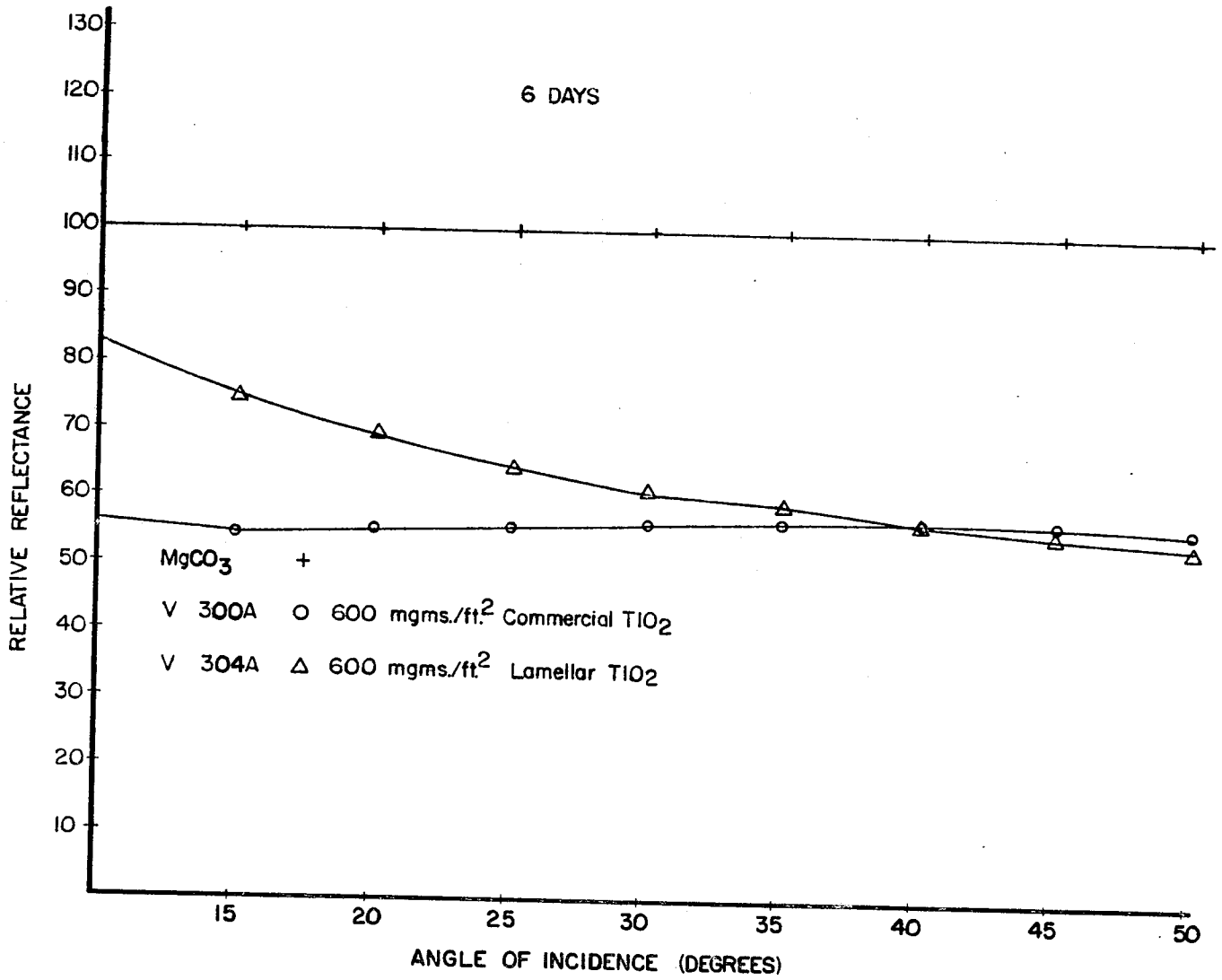
Figure 9:
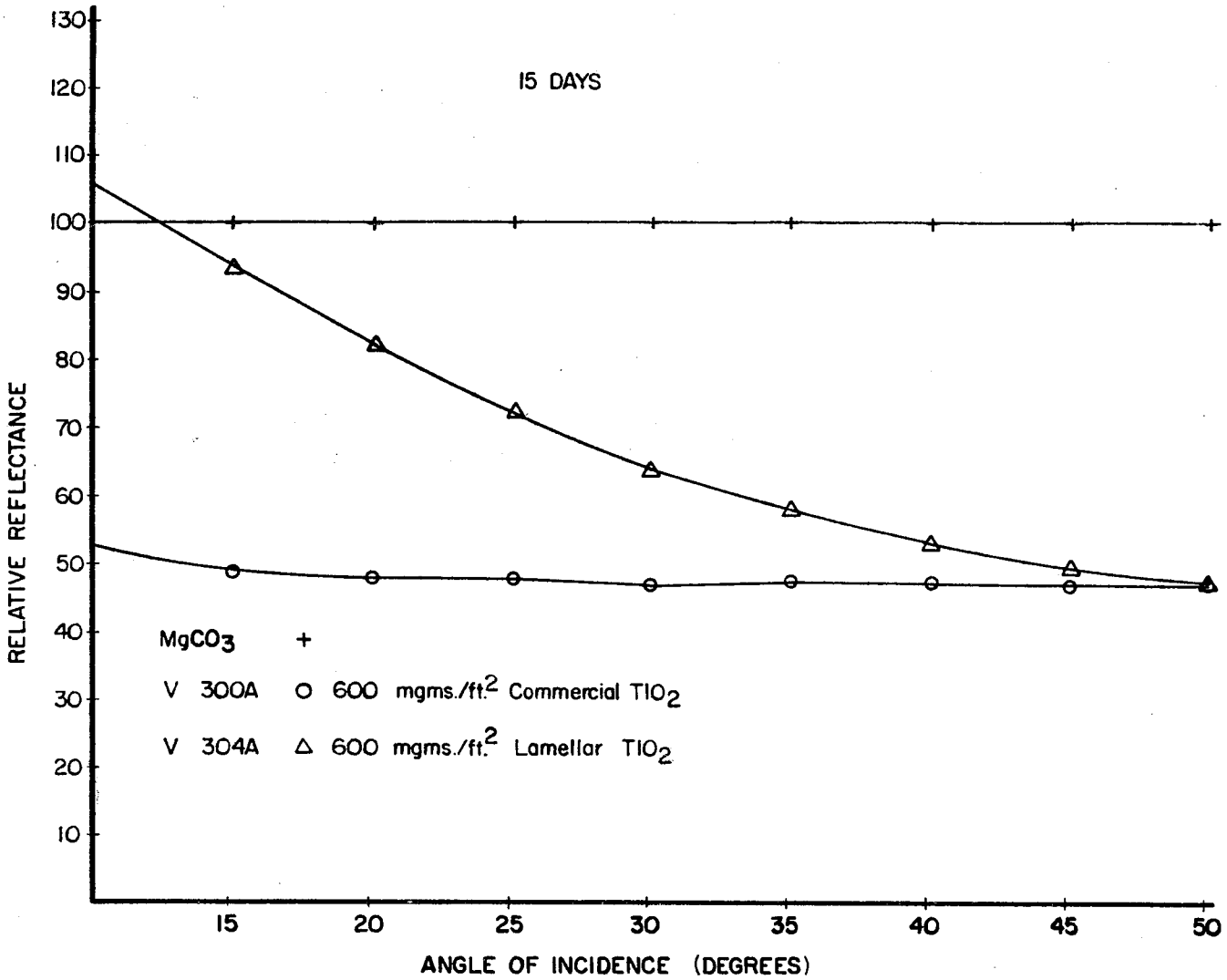

The data of Table 3 is depicted in FIGS. 7, 8 and 9 where it will be seen that the lamellar titanium dioxide layer (V304A) provides improved reflecting efficiency, especially at the lower angles of incidence, e.g., 10° to 35°. Also it will be seen that at the angles of 10° to 25° especially, there is a progressive increase in reflecting efficiency with time. Again, however, the differences between the reflecting layers of V300A and V304A were far more dramatic when the layers were examined visually. In terms of whiteness, brilliance, depth of reflection and marked directionality, the reflecting layer of V304A was much superior to the reflecting layer of V300A.

As mentioned, film units V300A and V304A were developed in the dark and accordingly, the processing compositions used did not contain organic, light-absorbing, pH-sensitive dyes of the type disclosed and claimed in referenced U.S. Pat. No. 3,647,437. As disclosed in U.S. Pat. No. 3,647,437, these light-absorbing dyes provide additional opacity during development—enough to permit development in the light- and are "cleared" or discharged, i.e., rendered substantially colorless or non-light-absorbing when this opacity is no longer required. The use of such dyes is, of course, contemplated in processing compositions of film units of the present invention, especially in film units of the type shown in FIG. 1.

Reflectance density measurements, the $D_{min}$ and $D_{max}$ portions of the transfer images, of film units V300A and V304A were made on a densitometer employing a 30° angle of incidence. No special storage conditions were provided for the film units during the test period; they remained in room light at ambient temperatures (70°–80° F.) and relative humidities of 35–50%. The density measurements were made at various intervals over a period of fifteen days; Table 4 summarizes the data obtained.

TABLE 4

REFLECTANCE DENSITY
AT 30° ANGLE OF INCIDENCE

| | | D-MIN. | | | D-MAX. | | |
|---|---|---|---|---|---|---|---|
| SAMPLE | DAY | R | G | B | R | G | B |
| V300A | 3 | 0.23 | 0.29 | 0.46 | 1.97 | 1.92 | 1.68 |
| V304A | 3 | 0.19 | 0.20 | 0.27 | 1.83 | 1.70 | 1.66 |
| V300A | 6 | 0.22 | 0.27 | 0.43 | 1.96 | 1.90 | 1.65 |
| V304A | 6 | 0.18 | 0.20 | 0.26 | 1.84 | 1.67 | 1.63 |
| V300A | 8 | 0.22 | 0.30 | 0.44 | 1.98 | 1.90 | 1.70 |
| V304A | 8 | 0.18 | 0.20 | 0.27 | 1.78 | 1.65 | 1.62 |
| V300A | 9 | 0.24 | 0.31 | 0.47 | 2.16 | 2.01 | 1.72 |
| V304A | 9 | 0.18 | 0.20 | 0.27 | 1.84 | 1.70 | 1.68 |
| V300A | 13 | 0.25 | 0.32 | 0.48 | 2.17 | 2.08 | 1.81 |
| V304A | 13 | 0.18 | 0.20 | 0.26 | 1.88 | 1.78 | 1.70 |
| V300A | 14 | 0.25 | 0.32 | 0.46 | 2.16 | 2.06 | 1.78 |
| V304A | 14 | 0.16 | 0.18 | 0.26 | 1.92 | 1.78 | 1.71 |
| V300A | 15 | 0.28 | 0.35 | 0.50 | 2.14 | 2.04 | 1.78 |
| V304A | 15 | 0.16 | 0.18 | 0.26 | 1.94 | 1.78 | 1.71 |

The D-min data of Table 4 are considered most significant, showing considerably less darkening or "staining" of the reflecting layer of V304A both initially and after fifteen days. Darkening or "staining" of the transfer image as viewed against the reflective pigment layer is a phenomenon oftentimes observed in integral film units of the type involved in this Example. The phenomenon has been generally attributed to post-processing transfer of ingredients of the photosensitive component, or by products of processing, to the image-receiving and/or reflecting layer, and/or undesired interaction with materials of the light-reflecting layer. Accordingly, lamellar pigment containing reflecting layers may also provide a desirable "anti-staining" capability for film units employing them and this advantage may be due to distinctive chemical and/or physical and/or optical differences existing between lamellar pigments and those conventionally used as reflecting pigments in photographic products. For example, the plate-like configuration and/or the orientation of the lamellar pigment of the reflecting layer V304A may prevent some of this post-processing transfer. In any event, the differences in the darkening or "staining" of the transfer images of the units are readily evident on visual examination and the visual differences are dramatically apparent.

EXAMPLE 5

This Example involves another comparison of reflecting layers of integral negative-positive film units of the type prepared in the manner described in the above Example. The film units involved were identical in terms of the composition and arrangement of their layers and in terms of the ingredients of their processing compositions except for the reflecting pigments involved. The processing composition of Film Unit V404 listed below contained the lamellar zirconium dioxide pigment of Example 2 in an amount sufficient to provide a reflecting layer having a coverage of about 1848 mgms./ft$^2$. The processing composition of Film Unit V405 (control) listed below contained a commercially available, electronic grade zirconium dioxide to provide a reflecting layer having a coverage of about 1871 mgms./ft$^2$. Also, the processing compositions of each film unit in this Example contained indicator dyes of the type described in U.S. Pat. No. 3,647,437 and accordingly the film units of this Example can be developed in light after distribution of the processing composition.

Exposure and processing of each film unit were done as described in Example 4 and reflectance density measurements were made on a densitometer employing a 30° angle of incidence from normal. The following data was obtained:

TABLE 6

| Film Unit No. | Day | D-Min. R | D-Min. G | D-Min. B | D-Max. R | D-Max. G | D-Max. B |
|---|---|---|---|---|---|---|---|
| V404 | 1 | 25 | .25 | .25 | 1.71 | 1.82 | 1.60 |
| V405 (Control) | 1 | .33 | .33 | .34 | 1.76 | 1.86 | 1.66 |
| V404 | 6 | .26 | .28 | .27 | 1.75 | 1.84 | 1.60 |
| V405 (Control) | 6 | .40 | .44 | .43 | 1.88 | 1.99 | 1.77 |
| V404 | 10 | .26 | .28 | .27 | 1.73 | 1.81 | 1.57 |
| V405 (Control) | 10 | .45 | .49 | .47 | 1.79 | 1.93 | 1.71 |

A visual comparison of the reflecting layers of Film Units V404 and V405 establishes that the reflecting layer containing the zirconium dioxide pigment of Example 2 is brighter and has better covering power. Also the above table clearly evidences that the $D_{min}$ measurements for the zirconium dioxide flake containing reflecting layer are lower and do not increase appreciably with time.

As mentioned, a distinct embodiment of this invention involves white light reflecting layers comprising multi-layer lamellar pigments. The multi-layer pigments of this invention comprise a plurality of layers with at least one layer having a geometric thickness within the expression described before and a refractive index of at least 1.7. The layer next to the layer having these specifications also has a geometric thickness within the expression but has a different refractive index. Accordingly, the multi-layer pigments of this invention comprise a plurality of layers with next adjacent layers each having a geometric thickness within the expression, each having a different refractive index and at least one of the adjacent layers has a refractive index above 1.7. Particularly preferred multilayer pigments of this invention are those having an odd number of layers with high refractive index layers (at least 1.7) separated by adjacent layers having a refractive index at least about 0.3 lower than the high refractive index layers.

Particularly efficient multi-layer lamellar pigments of this invention can be prepared using high refractive index layer providing materials having a refractive index above about 2.0 and next adjacent layer providing materials having a refractive index of about 1.5 or lower. Some consideration should be given to the compatibility of the selected layer materials with the ingredients of the processing composition unless, of course, the reflecting layer is isolated from the processing composition. For example, this consideration is not of special importance when multi-layer pigments of this invention are used to provide reflecting layers for peel-apart diffusion transfer film units e.g., film units of FIG. 3. Preferred layer providing materials, however, are those which are substantially stable and substantially insoluble in aqueous alkali processing compositions.

Multi-layer pigments of this invention have been prepared using zirconium and titanium dioxides as the high refractive index layer providing material with low refractive index layer providing materials such as magnesium fluoride, calcium fluoride, silicon dioxide, strontium fluoride and sodium alumino fluorides such as chiolite and crylolite. In terms of optical characteristics, these low refractive index layer providing materials are suitable for multi-layer pigments of this invention. Some, however, such as magnesium fluoride, silicon dioxide and calcium fluoride, for example, were found to exhibit an undesirable degree of incompatibility with the processing composition. Again, however, multi-layer pigments comprising these materials can be suitably employed where such compatibility is not a consideration. Of the above low refractive index layer providing materials, strontium fluoride is especially preferred; pigments comprising strontium fluoride layers have good optical properties combined with excellent processing composition compatibility.

In the preferred multi-layer pigments of this invention, the optical thickness of each layer is selected to provide maximum reflection for a wavelength or wavelength range of radiation in the visible region of the spectrum. For example, if 5500 Å is selected as the optimum wavelength, the desired optical thickness of each layer will be 5500/4 Å or 1375 Å. Given this value, the desired geometric or physical thickness for each layer is easily calculated as follows:

$$T(\text{or Geometric Thickness}) = \frac{1375\ \text{Å}}{\text{Refractive Index of Layer Material}}$$

Following these calculations, for example, the geometric thickness of the layers of a three layered pigment having two titanium dioxide layers with a layer of magnesium fluoride between them would be about 509 A for the titanium dioxide layers and about 996 A for the magnesium fluoride layer. These thicknesses are based on a refractive index of 2.7 for titanium dioxide and a refractive index of 1.38 for the magnesium fluoride.

From the above, it should be appreciated that the geometric thickness of each layer of the multi-layer pigment will be determined primarily by the wavelength or wavelength range of radiation for which maximum reflection efficiency is desired. That wavelength or wavelength range is preferably in the mid-visible region and can be the same for all layers of the pigment. However, it should be understood that the wavelength or wavelength range involved in determining the geometric thicknesses of the layer(s) need not be in the mid-visible region. Nor need it be the same for all the layers. In other words, multi-layer pigments of this invention also include those where the layers have geometric thicknesses designed to provide maximum reflection efficiency for radiation of different wavelengths or wavelength ranges of the visible region. For example, multi-layer pigments of this invention can include those with layers having geometric thicknesses designed to provide maximum reflection efficiency for radiation in the midvisible region while other layers can have geometric thicknesses designed to provide maximum reflection efficiency for radiation in the near or far-visible region or in a different portion of the mid-visible region. Also multi-layer pigments in which each layer has a different geometric thickness, are contemplated within the invention.

Methods of making and using multi-layer lamellar pigments of this invention will be more fully appreciated from the following Examples:

EXAMPLE 6

This Example illustrates a preparation of a multi-layer lamellar pigment of this invention. The particular multi-layer pigment prepared contained two titanium dioxide layers with a layer of magnesium fluoride sandwiched between them.

Using the vacuum chamber, vacuum coating apparatus and vacuum coating procedure of Example 2, a Mylar substrate was first coated with a release coat layer of sodium fluoride about 200 Å thick. A layer of titanium dioxide about 509 Å thick was vapor deposited on the release coat layer. The titanium dioxide coated substrate was then vapor coated with a layer of magnesium fluoride about 996 Å thick and a layer of titanium dioxide about 509 Å thick was then vapor deposited on the magnesium fluoride layer.

The multi-layer pigment was removed from the substrate, washed, dried, calcined and reduced in size in the manner described in Example 1 or 2.

EXAMPLE 7

This Example illustrates a preparation of another multi-layer lamellar pigment of this invention. The particular multi-layer pigment prepared contained five layers consisting of three titanium dioxide layers and two layers of magnesium fluoride with each layer of magnesium fluoride sandwiched between two titanium dioxide layers.

Using the same vacuum coating apparatus of Example 6 and substantially the same procedure as in Example 6, a five-layered pigment was prepared by successively coating a sodium fluoride coated (200 Å) Mylar substrate with a vapor deposited layer of titanium dioxide about 507 Å thick, a vapor deposited layer of magnesium fluoride about 979 Å thick another vapor deposited layer of titanium dioxide about 507 Å thick, another vapor deposited layer of magnesium fluoride about 979 Å thick, and finally another vapor deposited layer of titanium dioxide about 507 Å thick.

Again, removal of the five layer pigment from the release coated Mylar substrate, washing, drying, calcining and sonification were done as described before.

EXAMPLE 8

This Example illustrates a preparation of a multi-layer lamellar pigment of this invention. The particular pigment prepared was a three-layer pigment having two titanium dioxide layers with a layer of strontium fluoride sandwiched between them.

The three-layer pigment was prepared by following the procedure described in Example 6 but the layers successively vapor deposited on the sodium fluoride coated Mylar support were a vapor deposited layer of titanium dioxide about 507 Å thick, a vapor deposited layer of strontium fluoride about 965 Å thick and another vapor deposited layer of titanium dioxide about 507 Å thick.

EXAMPLE 9

This Example illustrates a preparation of another multi-layer pigment of this invention having two titanium dioxide layers with a layer of magnesium fluoride sandwiched between them.

The three-layer pigment was prepared by following the procedure described in Example 6 but the layers successively deposited on the sodium fluoride coated Mylar support were, a vapor deposited layer of titanium dioxide about 463 Å thick, a vapor deposited layer of magnesium fluoride about 996 Å thick and another vapor deposited layer of titanium dioxide about 463 Å thick.

EXAMPLE 10

This Example involves a comparison of reflecting layers of integral negative positive film units of the type prepared in the manner described in detail in Example 4. The film units involved here were identical in terms of the composition and arrangement of their layers and also in terms of their processing compositions except for the reflecting pigments involved. The processing composition of Film Unit V346 listed below contained the three-layer pigment of Example 6 as the reflecting pigment while the processing composition of Film Unit V 347 contained in rutile titanium dioxide (Ti-Pure R 100) mentioned before. The amount of reflecting pigment in each processing composition was enough to provide a total pigment coverage of 1667 mgms/ft$^2$ when distributed at a thickness of 0.0030 inches. The processing compositions also contained indicator dyes of the type described in U.S. Pat. No. 3,647,437 and therefore, these film units could be developed in light after distribution of the processing composition.

Exposure and processing of each film unit were done as described in Example 4 and reflectance density measurements were made on a densitometer employing a 30° angle of incidence. The following data were obtained:

TABLE 7

| Film Unit No. | Day | $D_{min}$ R | G | B |
|---|---|---|---|---|
| V346 | Initial | .13 | .13 | .18 |
| V347 | Initial | .16 | .19 | .22 |
| V346 | 14 | .07 | .08 | .14 |
| V347 | 14 | .17 | .23 | .29 |

Again, a progressive decrease in $D_{min}$ values with time is obtained with the film unit having the reflecting layer containing the multi-layer lamellar pigments of this invention.

Figure 10:
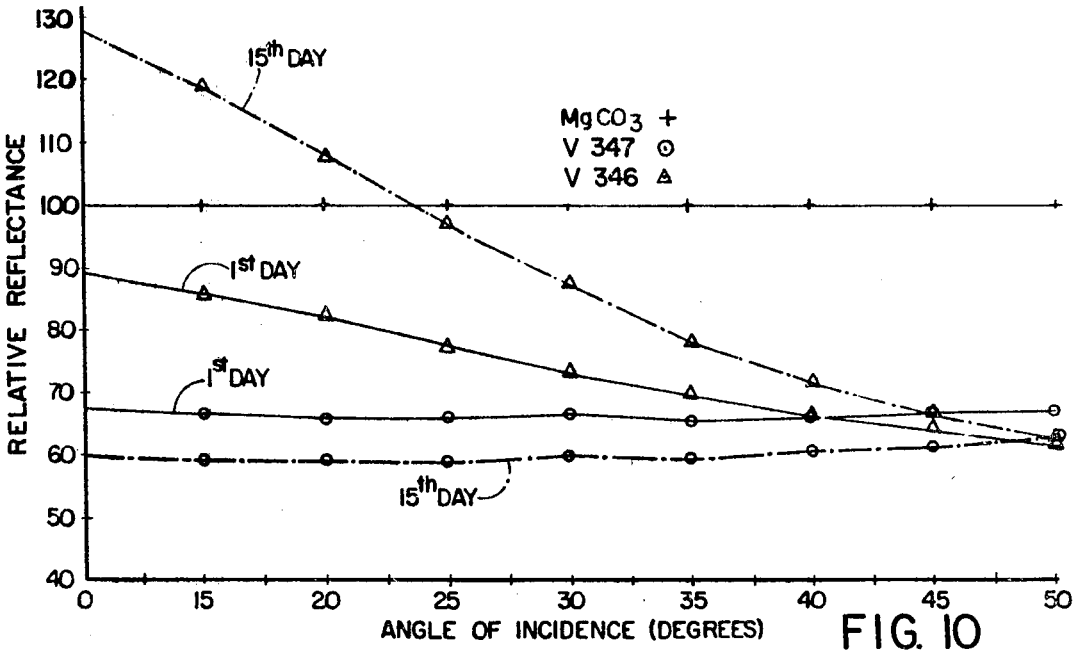
FIG. 10 graphically depicts data obtained in Example 10.

The changes in reflection vs angle of incidence were also measured in the manner described in Examples 3 and 4. FIG. 10 graphically depicts these measurements for both film units on the initial day (Day 1) and the fifteenth day (Day 15). The reflecting layer of film unit V 346 (with the multi-layer lamellar pigment) clearly shows improved reflection efficiency initially as well as dramatically improved reflection efficiency at the fifteenth day. However, the differences in reflection efficiency were best evidenced by a visual examination of the reflecting layers of Film Units V 346 and V 347. The reflecting layer of Film Unit V 346 was whiter, brighter, more directional and more pleasing in overall effects to the eye than the spherical titanium dioxide containing reflecting layer of Film Unit V 347.

EXAMPLE 11

This Example involves an integral negative positive film unit of the type prepared as described in Example 4. The processing composition of the film unit of this Example contained the five-layer pigment prepared as in Example 7 as the reflecting pigment. The amount of pigment used was enough to provide a reflecting pigment coverage of about 1750 mgms/ft$^2$ when the processing composition was distributed at a thickness of 0.0030 inch. Exposure and processing were done as described before and 30° reflectance density measurements were made; the following data were obtained:

TABLE 8

| Day | $D_{min}$ R | G | B | $D_{max}$ R | G | B |
|---|---|---|---|---|---|---|
| Initial | .17 | .14 | .15 | 1.54 | 1.72 | 1.55 |
| 4 | .15 | .11 | .11 | 1.51 | 1.65 | 1.47 |
| 10 | .13 | .09 | .09 | 1.51 | 1.61 | 1.46 |
| 39 | .11 | .09 | .09 | 1.50 | 1.60 | 1.43 |

A visual comparison of the reflecting layer of the film unit of this Example with the reflecting layer of film unit V347 of Example 10 revealed that the reflecting layer containing the five layer pigment provided increased brilliance and the highlights were more neutral.

EXAMPLE 12

This Example involves a comparison of reflecting layers of integral negative positive film units of the type prepared as described in Example 4. The film units were identical except for the reflecting layers involved. The processing composition of Film Unit V 381 contained the three-layer pigment prepared as in Example 8 as the reflective pigment while the processing composition of Film Unit V 379 contained rutile titanium dioxide (Ti-Pure R-100) as the reflective pigment. The amount of reflective pigment in each processing composition was enough to provide—on distribution at a 0.0030 gap—a pigment coverage in both film units of 1670 mgms/ft$^2$. Exposure and processing were done as described in earlier Examples and 30° reflectance density measurements were made. The following data was obtained:

TABLE 9

| Film Unit No. | Day | $D_{min}$ R | G | B | $D_{max}$ R | G | B |
|---|---|---|---|---|---|---|---|
| V381 | Initial | .11 | .11 | .13 | 1.43 | 1.56 | 1.42 |
| V379 | Initial | .15 | .17 | .19 | 1.76 | 1.95 | 1.70 |
| V381 | 10 | .08 | .09 | .08 | 1.55 | 1.66 | 1.44 |
| V379 | 10 | .20 | .25 | .28 | 1.83 | 1.97 | 1.73 |

Figure 11:
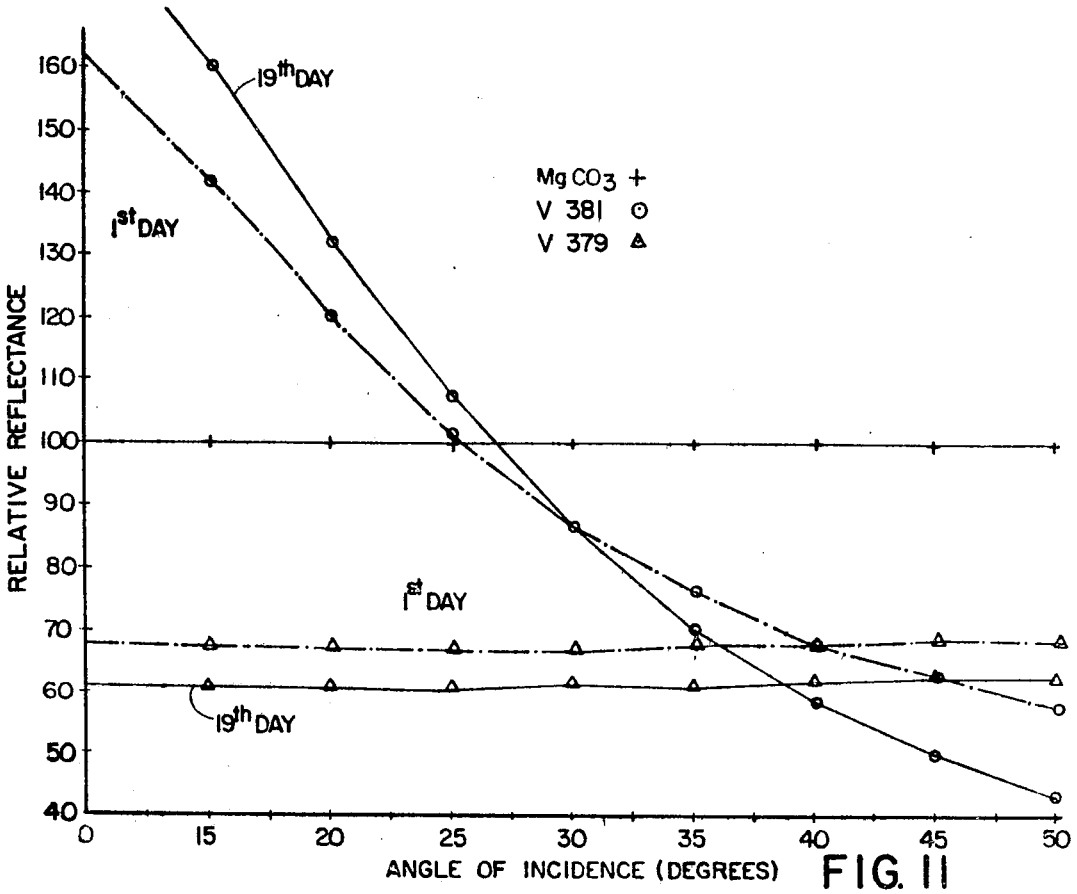
FIG. 11 graphically depicts data obtained in Example 12.

Changes in reflection vs angle of incidence were also measured as described in Examples 3 and 4. FIG. 11 graphically depicts these measurements for both film units on the initial day (Day 1) and the nineteenth day (Day 19). Referring to FIG. 11, it will be seen that there is a dramatic difference in reflectivity between the reflecting layers of Film Units V 381 and V 379 initially. And, these differences are even more striking at the nineteenth day.

EXAMPLE 13

This Example involves an integral negative positive film unit having a reflecting layer containing the three layer pigment prepared in Example 9. The amount of reflecting pigment included in the processing composition was enough to provide a pigment coverage of about 1656 mgms/ft$^2$ on a distribution at a thickness of 0.0030 inch. Exposure and processing were done as described before and 30° reflectance densities were measured. The following data were obtained:

TABLE 10

| Day | $D_{min}$ R | G | B | $D_{max}$ R | G | B |
|---|---|---|---|---|---|---|
| Initial | .25 | .18 | .15 | 1.59 | 1.72 | 1.51 |
| 3 | .21 | .16 | .14 | 1.51 | 1.59 | 1.42 |
| 22 | .16 | .12 | .11 | 1.58 | 1.62 | 1.42 |

The reflecting layer of this film unit is substantially similar to the reflecting layer of Film Unit V 346 of Example 10. The reflecting layers of both film units have substantially the same pigment coverage (about 1656 mgms/ft$^2$). Also the multi-layer pigments involved in preparing both reflecting layers comprise two titanium dioxide layers with a layer of magnesium fluoride sandwiched between them. However, a comparison of $D_{min}$ data for Film Unit V 346 of Table with the $D_{min}$ data of Table 10 above, reveals some interesting differences in color balance. In the $D_{min}$ data for Film Unit V 346, the blue (B) $D_{min}$ values are higher values while in the film unit of this Example, the Red (R) $D_{min}$ values are the higher.

This shift in color balance is attributed to the differences in the geometric thickness of the layers of the three layer pigments used to provide the reflecting layer. In the case of Film Unit V 346, the geometric thickness of each layer of the stack was designed to provide maximum reflective efficiency for a wavelength of 5500 Å. Accordingly, the geometric thickness of each titanium dioxide layer was about 509 Å while the geometric thickness of the magnesium fluoride layer was about 996 Å. However, the geometric thicknesses of the layers of the three layer pigment of this Example are designed to provide maximum reflection efficiency for a wavelength of 5000 Å—not 5500 Å. Accordingly, the geometric thickness of each titanium dioxide layer of the stacks of this Example is about 463 Å while the geometric thickness of the magnesium fluoride layer was about 906 Å.

The three layer pigment of this Example is therefore designed to provide increased blue reflectance and reflecting layers containing them show increased blue reflectivity and decreased red reflectivity. However, even though the highlights of the reflecting layer of this Example indicate a red $D_{min}$ balance, the red balance is not detected visually. Actually, the overall effect is rather pleasing and the highlights appear to be white. This capability of selectively adjusting the geometric thickness of the layers of the multi-layer lamellar pigment is an important feature of this invention permitting the design of multi-layer pigments having preselected reflection characteristics. Such "designed" multi-layer pigments are particularly useful in providing reflecting layers having reflection characteristics such as $D_{min}$ balance adjusted to a preselected degree. In the past, dyes have been employed to achieve such a preselected degree of adjustment and this use of dyes is described in U.S. Pat. No. 3,990,898.

Certain changes and modifications can be made in the products and processes described above without departing from the spirit and scope of the invention defined in the claims. Accordingly, all matter contained in the above description and drawings should be interpreted as illustrative and not in a limiting sense.

What is claimed is:

1. A photographic print comprising a support carrying an image-containing layer which is viewable against a substantially white layer comprising a lamellar pigment dispersed in a matrix material, said lamellar pigment having at least one layer with a geometric thickness of a value with the expression:

$$T = \frac{\lambda}{4} / n \text{ (or an odd multiple thereof)}$$

where: T is the geometric thickness of the layer, λ represents a wavelength or wavelength range of radiation in the visible region of the spectrum, n is the refractive index of the layer material and is at least 1.7, any layer adjacent said one layer having a geometric thickness of a value also within said expression but comprising a layer material having a refractive index different from the refractive index of said one layer.

2. A photographic print of claim 1 comprising in order, a transparent layer, the image containing layer, the substantially white layer and the support.

3. A photographic print of claim 1 further including a silver halide emulsion layer associated with image dye providing material said layer being positioned between said support and said substantially white layer.

4. A photographic print of claim 1 wherein said pigment is substantially stable and substantially insoluble in a diffusion transfer aqueous alkaline processing composition.

5. A photographic print of claim 1 where λ of said expression represents a wavelength or wavelength range of radiation between about 4500 Å to about 6500 Å.

6. A photographic print of claim 1 wherein λ of said expression represents a wavelength or wavelength range of radiation between about 5000 Å to about 5500 Å.

7. A photographic print of claim 1 where n of said one layer is between about 2.0 to about 2.8.

8. A photographic print of claim 7 wherein the geometric thickness of said one layer is within the range of from about 450 Å to about 700 Å.

9. A photographic print of claim 1 where λ of said expression represents a wavelength or wavelength range of radiation between about 5000 Å to about 5500 Å and n of said one layer is between about 2.0 to about 2.8.

10. A photographic print of claim 1 where said one layer is a layer of titanium dioxide.

11. A photographic print of claim 1 where said one layer is a layer of zirconium dioxide.

12. A photographic print of claim 1 where n of said adjacent layer is lower than n of said one layer.

13. A photographic print of claim 1 where n of said one layer is between about 2.0 to about 2.8 and the difference between n of said adjacent layer and n of said one layer is at least about 0.3.

14. A photographic print of claim 1 where n of said one layer is between about 2.0 to about 2.8 and n of said adjacent layer is below about 1.5.

15. A photographic print of claim 1 where said pigment comprises three or more layers.

16. A photographic print of claim 1 where said pigment comprises three or more layers and the number of said one layer(s) exceeds the number of said adjacent layer(s).

17. A photographic print of claim 1 where said one layer is a layer of titanium dioxide and said adjacent layer is a layer of strontium fluoride or magnesium fluoride.

18. A photographic print of claim 1 where said one layer is a layer of zirconium dioxide and said adjacent layer is a layer of strontium fluoride.

* * * * *